United States Patent [19]

Tamura et al.

[11] 4,086,897

[45] May 2, 1978

[54] EVAPORATED FUEL FEED CONTROL DEVICE FOR AN INTERNAL COMBUSTION ENGINE

[75] Inventors: Tetsuomi Tamura, Toyota; Koichi Mizutani, Seto; Toshiharu Matsuura, Toyota, all of Japan

[73] Assignee: Toyota Jidosha Kogyo Kabushiki Kaisha, Toyota, Japan

[21] Appl. No.: 785,673

[22] Filed: Apr. 7, 1977

[30] Foreign Application Priority Data

Dec. 28, 1976 Japan ..... 51-157561

[51] Int. Cl.[2] ..... F02M 39/00; F02M 23/04

[52] U.S. Cl. ..... 123/136; 123/124 R

[58] Field of Search ..... 123/136, 124 R; 137/DIG. 8; 251/61.5

[56] References Cited

U.S. PATENT DOCUMENTS

| | | | |
|---|---|---|---|
| 2,154,417 | 4/1939 | Anderson | 123/124 R |
| 2,311,351 | 2/1943 | Schmelz | 123/124 R |
| 3,561,412 | 2/1971 | Yagi | 123/124 R |
| 3,601,106 | 8/1971 | Nakajima | 123/124 R |
| 3,628,517 | 12/1971 | Soberski | 123/136 |
| 3,683,597 | 8/1972 | Beveridge et al. | 123/136 |
| 3,913,545 | 10/1975 | Hasse | 123/136 |

*Primary Examiner*—Charles J. Myhre
*Assistant Examiner*—Raymond A. Nelli
*Attorney, Agent, or Firm*—Stevens, Davis, Miller & Mosher

[57] ABSTRACT

Disclosed is an evaporated fuel feed control device for use in an internal combustion engine which comprises a charcoal canister and an evaporated fuel feed control valve. The feeding operation of the evaporated fuel is stopped only when the throttle valve is closed while the engine is operating at a high number of revolutions per minute, as in the case wherein the vehicle is decelerated while being driven at a high speed.

3 Claims, 2 Drawing Figures

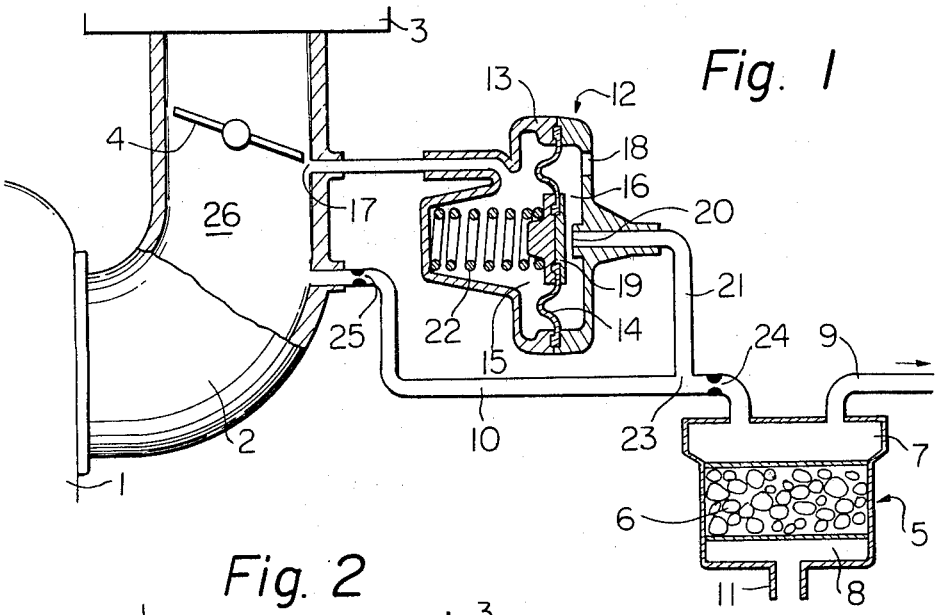
Fig. 1
Fig. 2
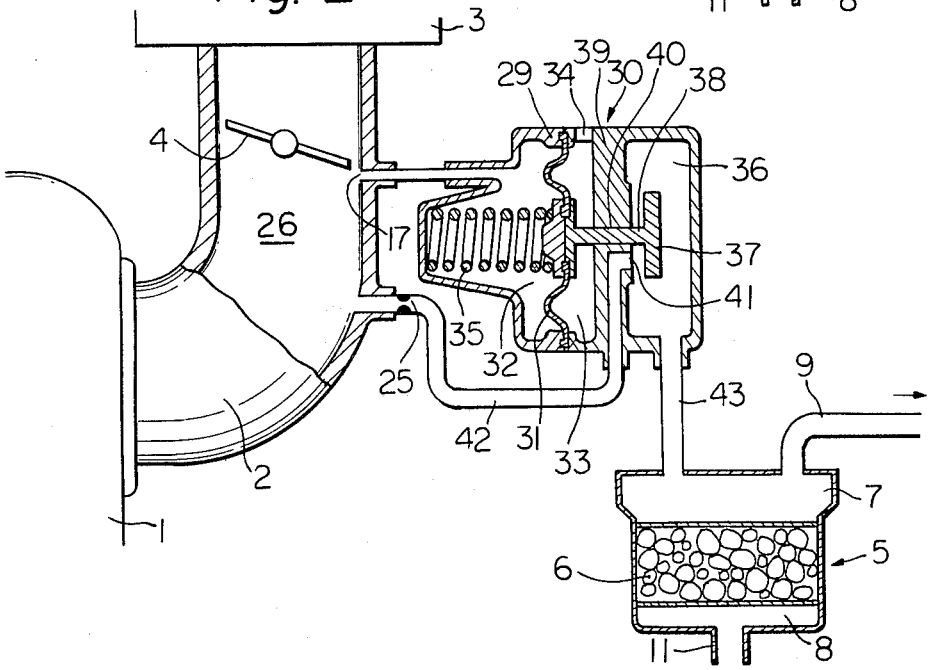

EVAPORATED FUEL FEED CONTROL DEVICE FOR AN INTERNAL COMBUSTION ENGINE

DESCRIPTION OF THE INVENTION

The present invention relates to a device for controlling the feeding of the gas of the fuel evaporated from the fuel tank and the carburetor (hereinafter referred to as an evaporated fuel) in an internal combustion engine.

In order to prevent the evaporated fuel from being discharged to the atmosphere, there has been known an evaporated fuel treating method in which the evaporated fuel is temporarily adsorbed in the charcoal and, then, the evaporated fuel adsorbed in the charcoal is desorbed when the engine is operating. Then, the evaporated fuel thus desorbed is fed into the cylinder of the engine and is burned therein. As an evaporated fuel feed control device using an evaporated fuel treating method of this type, there has been known an evaporated fuel feed control device in which the feeding operation of the evaporated fuel is stopped at the time of idling and deceleration. However, in this device, at the time of acceleration and at the time when a vehicle is driven at a constant speed, the amount of the evaporated fuel fed into the cylinder is increased by an amount of the evaporated fuel which is not adsorbed in the charcoal at the time of idling and deceleration. This results in a problem in that the amount of harmful HC and CO components in the exhaust gas is increased at the time of acceleration and at the time a vehicle is driven at a constant speed.

In general, especially when the throttle valve is rapidly closed while the engine is rotating at a high number of revolutions per minute, as in the case wherein the vehicle is decelerated while being driven at a high speed, an extremely rich air-fuel mixture is fed into the cylinder of the engine. That is, at the time of deceleration as mentioned above, since the vacuum level in the intake manifold becomes extremely high, the liquid fuel stuck to the inner wall of the intake manifold is vaporized. As a result of this, the air-fuel mixture fed into the cylinder becomes excessively rich. Consequently, at the time of deceleration as mentioned above, if the evaporated fuel is fed into the cylinder, the air-fuel mixture fed into the cylinder becomes further excessively rich and, as a result, the amount of harmful HC and CO components in the exhaust gas is increased. In addition, in an internal combustion engine provided with a catalytic converter, there occurs a problem in that the catalytic converter is overheated.

An object of the present invention is to provide an evaporated fuel feed control device capable of reducing the amount of harmful HC and CO in the exhaust gas at the time of acceleration and at the time a vehicle is driven at a constant speed, and also capable of preventing an increase in the amount of harmful HC and CO in the exhaust gas when the throttle valve of the carburetor is closed while the engine is operating at a high number of revolutions per minute (RPM) in such a way that the feeding operation of the evaporated fuel is stopped when the throttle valve is closed during high engine RPM, and the evaporated fuel is fed into the cylinder at the time of idling and at the time the throttle valve is closed during low engine RPM.

According to the present invention, there is provided a device for controlling the feeding of the evaporated fuel of an internal combustion engine which is provided with an intake passage having a throttle valve therein, said device comprising a charcoal canister for adsorbing the evaporated fuel therein, a passage means communicating said canister with said intake passage downstream of said throttle valve for feeding the evaporated fuel into said intake passage, a vacuum port opening into said intake passage at a position downstream of said throttle valve when said throttle valve is in the closed position, and opening into said intake passage at a position upstream of said throttle valve when the throttle valve is opened, and a means for stopping the feeding operation of the evaporated fuel in response to a change in the vacuum level in said vacuum port when the vacuum level in said vacuum port is increased beyond a predetermined vacuum level which is greater than the level of the vacuum produced in said intake passage at the time of idling of the engine.

The present invention may be more fully understood from the following description of preferred embodiments of the invention, together with the accompanying drawings.

BRIEF DESCRIPTION OF THE DRAWINGS

In the drawings:

FIG. 1 is a schematic view of an embodiment of an evaporated fuel feed control device according to the present invention, and;

FIG. 2 is a schematic view of an alternative embodiment according to the present invention.

DESCRIPTION OF PREFERRED EMBODIMENTS

Referring to FIG. 1, 1 designates an engine body, 2 an intake manifold, 3 a carburetor, 4 a throttle valve, 5 a charcoal canister, 12 a vacuum operated valve and 26 an intake passage formed in the intake manifold 2. The charcoal canister 5 has therein a charcoal layer 6, an upper chamber 7 and a lower chamber 8 which are separated by the charcoal layer 6. The upper chamber 7 is connected to, for example, a fuel tank (not shown) via a conduit 9, while the upper chamber 7 is connected to the intake manifold 2 at a position downstream of the throttle valve 4 via an evaporated fuel conduit 10. On the other hand, the lower chamber 8 is connected to the atmosphere via a conduit 11. The vacuum operated valve 12 has in its housing 13 a vacuum chamber 15 and an atmospheric pressure chamber 16 which are separated by a diaphragm 14. The vacuum chamber 15 is connected to a vacuum port 17 opening into the intake passage 26 at a position downstream of the throttle valve 4 when the throttle valve 4 is in the closed position, and opening into the intake passage 26 at a position upstream of the throttle valve 4 when the throttle valve 4 is opened. On the other hand, the atmospheric pressure chamber 16 is connected to the atmosphere via an opening 18. A valve body 19 is fixed onto the central portion of the diaphragm 14, and an air bleed nozzle 20 is formed on the housing 13 so as to face the valve body 19. The air bleed nozzle 20 is connected to the evaporated fuel conduit 10 via an air bleed pipe 21. A compression spring 22 is disposed between the diaphragm 14 and the inner wall of the housing 13, and the diaphragm 14 is always biased towards the right in FIG. 1 due to the spring force of the compression spring 22. The spring force of the compression spring 22 is set so that the valve body 19 opens the air bleed nozzle 20 when the vacuum level in the vacuum chamber 15 is increased beyond the vacuum level, for example −500 mmHg, which is greater than the level of the vacuum produced in the intake passage 26 at the time of engine idling. A restricted opening 24 is disposed in the evaporated fuel conduit 10 located between the upper chamber 7 and the jointing portion 23 of the air bleed pipe 21 and the evaporated fuel conduit 10. On the other hand, a restricted opening 25 is disposed in the evaporated fuel conduit 10 in the vicinity of the intake passage 26 for regulating the amount of evaporated fuel fed into the intake manifold 2.

The evaporated fuel, which is created in the fuel tank when the engine is operating and when the engine is stopped, is introduced into the upper chamber 7 of the charcoal canister 5 via the conduit 9 and is adsorbed in the charcoal layer 6. Assuming that the engine is operating and the throttle valve 4 is opened, since the vacuum port 17 opens into the intake passage 26 upstream of the throttle valve 4, the pressure in the vacuum chamber 15 of the vacuum operated valve 12 is approximately equal to atmospheric pressure. Consequently, at this time, since the diaphragm 14 is urged towards the right in FIG. 1 due to the spring force of the compression spring 22, the valve body 19 is maintained at a position where it closes the air bleed nozzle 20. Therefore, at this time, while air is sucked into the intake manifold 2 via the conduit 11, the lower chamber 8, the charcoal layer 6, the upper chamber 7 and the evaporated fuel conduit 10, the evaporated fuel adsorbed in the charcoal is desorbed by the air passing through the charcoal layer 6 and, thus, the air containing the evaporated fuel therein is fed into the intake manifold 2 via the evaporated fuel conduit 10.

When the engine is operating in an idling condition in which the throttle valve 4 is in the closed position as shown in FIG. 1, the vacuum level in the intake passage 26 is equal to approximately −400 mmHg through −450 mmHg. Consequently, at this time, since the valve body 19 is maintained in a position where it closes the air bleed nozzle 20, the evaporated fuel is fed into the intake manifold 2.

When the throttle valve 4 is closed while the engine is operating at a small number of revolutions per minute, as in the case wherein the vehicle is decelerated while being driven at a low speed, the vacuum level in the intake passage 26 becomes greater than the level of the vacuum produced at the time of idling but smaller than the vacuum level necessary to move the diaphragm 14 towards the left in FIG. 1 against the spring force of the compression spring 22. As a result of this, the valve body 19 is maintained in a position where it closes the air bleed nozzle 20 and, thus, the evaporated fuel is fed into the intake manifold 2.

Contrary to the above, when the throttle valve 4 is closed while the engine is operating at a high number of revolutions per minute, as in the case wherein the vehicle is decelerated while being driven at a high speed, the vacuum level in the intake passage 26 becomes greater than the vacuum level necessary to move the diaphragm 14 towards the left in FIG. 1 against the spring force of the compression spring 22. As a result of this, since the diaphragm 14 moves towards the left in FIG. 1, the valve body 19 stops closing the air bleed nozzle 20. Thus, air containing no evaporated fuel therein due to the presence of the restricted opening 24 is fed into the intake manifold 2 via the opening 18, the atmospheric pressure chamber 16, the air bleed pipe 21 and the evaporated fuel conduit 10. Consequently, when the throttle valve 4 is closed while the engine is operating at a high number of revolutions per minute, the feeding operation of the evaporated fuel remains stopped. In addition, at this time, since the liquid fuel stuck on the inner wall of the intake manifold 2 is vaporized due to a rapid increase in the vacuum level in the intake passage 26 as is hereinbefore mentioned, a rich air-fuel mixture is formed in the intake manifold 2. However, as mentioned above, since air containing no evaporated fuel therein is fed into the rich air-fuel mixture formed in the intake manifold 2, the rich air-fuel mixture is deluted, thus reducing an amount of harmful HC and CO components in the exhaust gas.

FIG. 2 shows an alternative embodiment of the device shown in FIG. 1. In FIG. 2, similar components are indicated with the same reference numerals used in FIG. 1. Referring to FIG. 2, a vacuum operated valve 30 has in its housing 29 a diaphragm 31 which separates a vacuum chamber 32 from an atmospheric pressure chamber 33. The vacuum chamber 32 is connected to the vacuum port 17 and, on the other hand, the atmospheric pressure chamber 33 is connected to the atmosphere via an opening 34. A compression spring 35 is disposed between the diaphragm 31 and the inner wall of the housing 29, and the diaphragm 31 is always biased towards the right in FIG. 2 due to the spring force of the compression spring 35. The spring force of the compression spring 35 is set so that the diaphragm 31 moves towards the left in FIG. 2 against the spring force of the compression spring 35 when the vacuum level in the vacuum chamber 32 is increased beyond, for example −500 mmHg similar to the embodiment shown in FIG. 1. An evaporated fuel introducing chamber 36 is formed in the housing 29 of the vacuum operated valve 30, and a valve body 37 is disposed in the evaporated fuel introducing chamber 36. The valve rod 38 of the valve body 37 passes through a hole 40 formed on a partition 39 and is connected to the diaphragm 31. A valve port 41 opening into the evaporated fuel introducing chamber 36 is formed on the partition 39 so as to face the rear side of the valve body 37. This valve port 41 is connected to the intake manifold 2 via an evaporated fuel conduit 42. The evaporated fuel introducing chamber 36 is connected to the upper chamber 7 via an evaporated fuel conduit 43.

When the throttle valve 4 is opened, the pressure in the vacuum chamber 32 becomes approximately equal to atmospheric pressure. As a result of this, the valve port 41 is opened and, thus, the evaporated fuel is fed into the intake manifold 2. Similar to the embodiment shown in FIG. 1, at the time of idling and at the time when the throttle valve 4 is closed while the engine is operating at a small number of revolutions per minute, since the valve port 41 is maintained open, the evaporated fuel is fed into the intake manifold 2. Contrary to this, when the throttle valve 4 is closed while the engine is operating at a high number of revolutions per minute, the vacuum level in the intake passage 26 becomes larger than the vacuum level necessary to move diaphragm 31 towards the left in FIG. 2 against the spring force of the compression spring 35. As a result of this, since the diaphragm 31 moves towards the left in FIG. 2, the valve body 37 closes the valve port 41, whereby the feeding operation of the evaporated fuel is stopped.

The evaporated fuel feed control device hereinbefore described is advantageously applied to an internal combustion engine provided with a secondary air feed device and a catalytic converter in the exhaust system. That is, in an internal combustion engine of this type, since secondary air is usually fed into the exhaust system at the time of idling and at the time the throttle valve is closed while the engine is operating at a small number of revolutions per minute, as in the case wherein the vehicle is decelerated while being driven at a low speed, the amount of oxygen in the exhaust gas becomes excessive. Consequently, even if the evaporated fuel is fed into the intake system of the engine at the time of idling and deceleration and, as a result, the air-fuel mixture fed into the cylinder becomes slightly rich, there is no danger that the amount of harmful HC and CO components in the exhaust gas will be increased.

According to the present invention, particularly at the time of acceleration and at the time a vehicle is driven at a constant speed, the amount of harmful HC and CO components in the exhaust gas can be reduced while preventing the evaporated fuel from being discharged to the atmosphere. In addition, if an internal combustion engine is provided with a catalytic converter, there is no danger that the catalytic converter will be overheated.

While the invention has been described by reference to specific embodiments chosen for purposes of illustration, it should be apparent that numerous modifications could be made thereto by those skilled in the art without departing from the spirit and scope of the invention.

What is claimed is:

1. A device for controlling the feeding of the evaporated fuel of an internal combustion engine which is provided with an intake passage having a throttle valve therein, said device comprising:

a charcoal canister for absorbing the evaporated fuel therein;

a passage means communicating said canister with said intake passage downstream of said throttle valve for feeding the evaporated fuel into said intake passage;

a vacuum port opening into said intake passage at a position downstream of said throttle valve when said throttle valve is in the closed position, and opening into said intake passage at a position upstream of said throttle valve when the throttle valve is opened, and;

a means for stopping the feeding operation of the evaporated fuel in repsonse to a change in the vacuum level in said vacuum port when the vacuum level in said vacuum port is increased beyond a predetermined vacuum level which is greater than the level of the vacuum produced in said intake passage at the time of idling the engine, said stopping means comprising a valve device establishing a fluid connection between said passage means and the atmosphere for feeding bleed air into said passage means when the vacuum level in said vacuum port is increased beyond said predetermined vacuum level.

2. A device as claimed in claim 1, wherein said valve device comprises a diaphragm type valve device operated in response to a change in the vacuum level in said vacuum port.

3. A device as claimed in claim 1, wherein a restricted opening is disposed in said passage means located between said canister and a position in said passage means at which the bleed air is fed into said passage means.

* * * * *